US009090853B2

(12) United States Patent
Holderbaum et al.

(10) Patent No.: US 9,090,853 B2
(45) Date of Patent: Jul. 28, 2015

(54) THICKENED FABRIC SOFTENER COMPRISING FREE PALMITIC ACID TO INCREASE VISCOSITY

(71) Applicant: Henkel AG & Co. KGaA, Duesseldorf (DE)

(72) Inventors: Thomas Holderbaum, Hilden (DE); Tatiana Schymitzek, Krefeld (DE); Noelle Wrubbel, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/716,270

(22) Filed: Dec. 17, 2012

(65) Prior Publication Data

US 2013/0102520 A1 Apr. 25, 2013

Related U.S. Application Data

(63) Continuation of application No. PCT/EP2011/057554, filed on May 10, 2011.

(30) Foreign Application Priority Data

Jun. 17, 2010 (DE) ..... 10 2010 030 217

(51) Int. Cl.

| | |
|---|---|
| ***C11D 1/62*** | (2006.01) |
| ***C11D 7/26*** | (2006.01) |
| ***C11D 3/00*** | (2006.01) |
| ***C11D 3/20*** | (2006.01) |

(52) U.S. Cl.

CPC ..... *C11D 3/0015* (2013.01); *C11D 1/62* (2013.01); *C11D 3/2013* (2013.01); *C11D 3/2079* (2013.01); *C11D 3/2093* (2013.01)

(58) Field of Classification Search

CPC ..... C11D 1/62; C11D 3/001; C11D 3/0015; C11D 7/26; C11D 7/265

See application file for complete search history.

(56) References Cited

U.S. PATENT DOCUMENTS

| | | | | |
|---|---|---|---|---|
| 4,844,823 | A | 7/1989 | Jacques et al. | |
| 5,580,481 | A * | 12/1996 | Sakata et al. | 510/527 |
| 6,984,618 | B2 * | 1/2006 | Heinzman et al. | 510/507 |
| 2001/0044406 | A1 * | 11/2001 | Baker et al. | 510/515 |
| 2010/0190397 | A1 * | 7/2010 | Duschek et al. | 442/59 |

FOREIGN PATENT DOCUMENTS

| | | | |
|---|---|---|---|
| EP | 0013780 | A1 | 8/1980 |
| EP | 0122141 | A2 | 10/1984 |
| EP | 0394133 | A1 | 10/1990 |
| EP | 0763592 | A1 | 3/1997 |
| GB | 1487432 | | 9/1977 |
| GB | 2388610 | A | 11/2003 |
| WO | 94/04642 | A2 | 3/1994 |
| WO | 94/04643 | A1 | 3/1994 |
| WO | 03/022969 | A1 | 3/2003 |

OTHER PUBLICATIONS

PCT International Search Report (PCT/EP2011/057554) dated Nov. 10, 2011.

* cited by examiner

*Primary Examiner* — Charles Boyer
(74) *Attorney, Agent, or Firm* — David K. Benson

(57) ABSTRACT

A thickened fabric softener includes 1 to 5 wt % textile-softening compound and a selected $C_{16}$ fatty material as a thickening agent.

4 Claims, No Drawings

THICKENED FABRIC SOFTENER COMPRISING FREE PALMITIC ACID TO INCREASE VISCOSITY

FIELD OF THE INVENTION

The present invention generally relates to a thickened fabric softener. The present invention also relates to the use of the fabric softener and to a method for manufacturing it.

BACKGROUND OF THE INVENTION

Fabric softeners are added to the laundry in the last rinse step of machine laundering in order to suppress the "dry stiffness" effect that occurs as the laundry dries. Dry stiffness is caused by the formation of hydrogen bridge bonds between the cellulose fibers. The cationic surfactants of the fabric softener penetrate into the fibers and/or become deposited onto the fiber surface, attach themselves to the negative charges, and thereby attenuate the interactions. The resulting decrease in the stiffness of the laundered item results in reduced effort when ironing, and increased wearing comfort.

Liquid fabric softeners are divided into two types: "normal" fabric softeners having a 1- to 5-wt % concentration of softening compounds, and "concentrated" fabric softeners having a 5- to 80-wt % concentration of softening compounds.

The acceptance of a fabric softener product by users is determined not only by its actual performance but also greatly by the viscosity of the product; medium to high viscosities are preferred by users. For normal fabric softeners, viscosities in the range from 100 to 500 mPas (determined using a Brookfield RV DV II+P viscosimeter, spindle 2, at 20 rpm and 20° C.) are desirable.

With normal fabric softeners in particular, the viscosity after manufacture is often too low, and thickeners are added to the products in order to increase the viscosity. EP 0763592 A1, for example, describes the use of fatty acids, in particular unsaturated fatty acids, as thickeners in fabric softeners.

A demand still exists, however, for maximally effective and inexpensive thickening agents for normal fabric softeners. An object of this invention was therefore to make available a thickened fabric softener, having 1 to 5 wt % fabric-softening compound, that can be manufactured inexpensively.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A liquid fabric softener includes 1 to 5 wt % textile-softening compound, based on the total fabric softener, and a $C_{16}$ fatty material that is selected from the group encompassing palmitic acid, palmitic acid methyl ester, palmitic acid ethyl ester, palmitic acid isopropyl ester, hexadecanol, palmitic acid amide, hexadecanal, palmitic acid ethanolamide, palmitic acid propanolamide, and mixtures thereof.

Another aspect of the invention includes the use of a $C_{16}$ fatty material that is selected from the group encompassing palmitic acid, palmitic acid methyl ester, palmitic acid ethyl ester, palmitic acid isopropyl ester, hexadecanol, palmitic acid amide, hexadecanal, palmitic acid ethanolamide, palmitic acid propanolamide, and mixtures thereof, to increase the viscosity of a liquid fabric softener containing 1 to 5 wt % textile-softening compound based on the total fabric softener.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has become apparent, surprisingly, that the use of one of the aforesaid saturated $C_{16}$ fatty materials in smaller quantities results in higher viscosity values in normal fabric softeners than when unsaturated fatty materials, or fatty materials having longer or shorter alkyl chains, are used. The use of saturated $C_{16}$ fatty materials has the further advantage that they cannot be oxidized to malodorous compounds during storage of the fabric softener, in particular after initial use.

In a preferred embodiment, the liquid fabric softener contains palmitic acid, hexadecanol, palmitic acid amide, and mixtures thereof. In a particularly preferred embodiment, the fabric softener contains palmitic acid as a thickening agent. These thickening agents, even in very small quantities, produce sufficient thickening of the fabric softener and are thus inexpensive and effective thickening agents.

It is also preferred that the textile-softening compound be selected from the group of the quaternary ammonium compounds, cationic polymers, polysiloxanes, textile-softening clays, and mixtures thereof.

These compounds are effective and commercially readily available textile-softening compounds.

It is further advantageous that the fabric softener contains a quaternary ammonium compound as a textile-softening compound.

It is particularly preferred that the quaternary ammonium compound be a compound of the following formula:

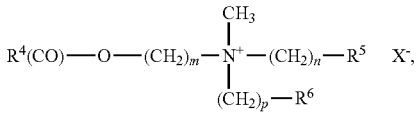

where $R^4$ denotes an aliphatic alk(en)yl residue having 11 to 21 carbon atoms, having 0, 1, 2, or 3 double bonds and/or optionally having substituents; $R^5$ denotes H, OH, or O(CO)$R^7$, $R^6$, independently of $R^5$, denotes H, OH, or O(CO)$R^8$, where $R^7$ and $R^8$ each denote, mutually independently, an aliphatic alk(en)yl residue having 11 to 21 carbon atoms having 0, 1, 2, or 3 double bonds, m, n, and p can each, mutually independently, have the value 1, 2, or 3, and $X^-$ can be either a halide ion, methosulfate ion, methophosphate ion, or phosphate ion, as well as mixtures of said anions.

In fabric softeners that contain quaternary ammonium compounds and in particular mono-, di-, and/or triesters of fatty acids with alkanolamines as textile-softening compounds, a particularly pronounced elevation of viscosity is produced by a $C_{16}$ fatty material.

Particularly inexpensive fabric softeners having a viscosity accepted by the consumer as being sufficiently high are obtained when the ratio of textile-softening compound to $C_{16}$ fatty material is greater than 25:1, and is preferably in the range from 150:1 to 50:1.

The invention furthermore relates to the use of a liquid fabric softener according to the present invention for conditioning textile fabrics.

The invention moreover relates to the use of a $C_{16}$ fatty material that is selected from the group encompassing palmitic acid, palmitic acid methyl ester, palmitic acid ethyl ester, palmitic acid isopropyl ester, hexadecanol, palmitic acid amide, hexadecanal, palmitic acid ethanolamide, palmitic acid propanolamide, and mixtures thereof, to increase the viscosity of a liquid fabric softener containing 1 to 5 wt % textile-softening compound based on the total fabric softener.

The invention also relates to a method for manufacturing a fabric softener containing 1 to 5 wt % textile-softening quaternary ammonium compound based on the total fabric softener, and a $C_{16}$ fatty material that is selected from the group encompassing palmitic acid, palmitic acid methyl ester, palmitic acid ethyl ester, palmitic acid isopropyl ester, hexadecanol, palmitic acid amide, hexadecanal, palmitic acid ethanolamide, palmitic acid propanolamide, and mixtures thereof, in which the textile-softening quaternary ammonium compound and the $C_{16}$ fatty material are melted together and the resulting melt is dispersed in a solvent.

This method procedure is particularly simple, because an additional metering system for the $C_{16}$ fatty material is not needed.

Fabric softeners according to the present invention will be described in detail below, including with reference to examples.

Fabric softeners according to the present invention obligatorily contain 1 to 5 wt % textile-softening compound based on the total fabric softener, and a $C_{16}$ fatty material. The $C_{16}$ fatty material functions in this context as a thickening agent.

The $C_{16}$ fatty material encompasses palmitic acid, palmitic acid methyl ester, palmitic acid ethyl ester, palmitic acid isopropyl ester, hexadecanol, palmitic acid amide, hexadecanal, palmitic acid ethanolamide, palmitic acid propanolamide, and mixtures thereof. Of these $C_{16}$ fatty materials, palmitic acid, hexadecanol, palmitic acid amide, or mixtures thereof are used by preference as a thickening agent in a normal fabric softener.

Particularly preferably, palmitic acid is used as a $C_{16}$ fatty material.

Palmitic acid is the saturated fatty acid that occurs most often in many vegetable and animal fats and fatty oils. It has become apparent, surprisingly, that palmitic acid, even in very small quantities, exhibits particularly good thickening performance in normal fabric softeners, and especially in normal fabric softeners having quaternary ammonium compounds as a textile-softening compound.

In addition to the $C_{16}$ fatty material, the fabric softeners contain a textile-softening component. These can encompass quaternary ammonium compounds, cationic polymers, polysiloxanes, textile-softening clays, and mixtures thereof.

The textile-softening component preferably encompasses quaternary ammonium compounds such as mono alk(en)yltrimethylammonium compounds, dialk(en)yldimethylammonium compounds, mono-, di-, and/or triesters of fatty acids with alkanolamines.

Suitable examples of quaternary ammonium compounds are shown, for example, in formulas (I) and (II):

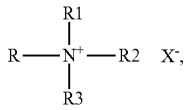

(I)

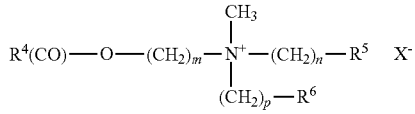

(II)

where, in (I), R denotes a acyclic alkyl residue having 12 to 24 carbon atoms, $R^1$ denotes a saturated $C_1$ to $C_4$ alkyl or hydroxyalkyl residue, $R^2$ and $R^3$ are either identical to R or $R^1$ or denote an aromatic residue. $X^-$ denotes either a halide ion, methosulfate ion, methophosphate ion, or phosphate ion, as well as mixtures thereof. Examples of cationic compounds of formula (I) are monotallowtrimethylammonium chloride, mono stearyltrimethylammonium chloride, didecyldimethylammonium chloride, ditallowdimethylammonium chloride, or dihexadecylammonium chloride.

Compounds of formula (II) are so-called "esterquats." Esterquats are notable for outstanding biodegradability. In formula (II), $R^4$ denotes an aliphatic alk(en)yl residue having 11 to 21 carbon atoms with 0, 1, 2, or 3 double bonds and/or optionally having substituents; $R^5$ denotes H, OH, or O(CO)$R^7$; and $R^6$ denotes, independently of $R^5$, H, OH, or O(CO)$R^8$, where $R^7$ and $R^8$ each denote, mutually independently, an aliphatic alk(en)yl residue having 11 to 21 carbon atoms with 0, 1, 2, or 3 double bonds. m, n, and p can each, mutually independently, have the value 1, 2, or 3. $X^-$ can be either a halide ion, methosulfate ion, methophosphate ion, or phosphate ion, as well as mixtures of said anions. Compounds in which $R^5$ represents the group O(CO)$R^7$ are preferred. Compounds in which $R^5$ represents the group O(CO)$R^7$, and $R^4$ and $R^7$ are alk(en)yl residues having 15 to 17 carbon atoms, are particularly preferred. Compounds in which $R^6$ additionally denotes OH are especially preferred.

Compounds of formula (II) are preferably used as textile-softening compounds in the fabric softeners according to the present invention.

Esterquats preferred for use as softening components are methyl-N-(2-hydroxyethyl)-N,N-di(tallowacyloxyethyl)ammonium methosulfate, methyl-N-(2-hydroxyethyl)-N,N-di(palmacyloxyethyl)ammonium methosulfate, 1,2-bis-[tallowacyloxy]-3-trimethylammonium propane chloride, N,N-dimethyl-N,N-di(tallowacyloxyethyl)ammonium methosulfate, N,N-dimethyl-N,N-di(tallowacyloxyethyl) ammonium chloride, or methyl-N,N-bis(stearoyloxyethyl)-N-(2-hydroxyethyl)ammonium methosulfate.

If quaternized compounds of formula (II) comprising unsaturated alkyl chains are used, the preferred acyl groups are those whose corresponding fatty acids have an iodine number between 1 and 100, preferably between 5 and 80, more preferably between 10 and 60, and in particular between 15 and 45, and have a cis/trans isomer ratio (in wt %) greater than 30:70, by preference greater than 50:50, and in particular greater than or equal to 60:40. Commercially usual examples are the methylhydroxyalkyldialkoyloxyalkylammonium methosulfates marketed by the Stepan company under the Stepantex® trademark, or the products of Cognis known under the trade name Dehyquart®, the Evonik products known as Rewoquat®, and the Kao products known as Tetranyl®.

Instead of the ester group O(CO)R, where R denotes a long-chain alk(en)yl residue, it is possible to use softening compounds that comprise the following groups: RO(CO), N(CO)R, or RN(CO); of these groups, N(CO)R groups are preferred.

Cationic polymers are also suitable textile-softening compounds, These in some cases additionally exhibit skin- and/or textile-care properties. Suitable cationic polymers encompass, in particular, those that are described in the "CTFA International Cosmetic Ingredient Dictionary," fourth edition, J. M. Nikitakis et al., editors, published by the Cosmetic, Toiletry, and Fragrance Association, 1991, and grouped under the general designation "Polyquaternium."

Polysiloxanes that can preferably be used as a textile-softening compound are polydimethylsiloxanes or substituted polysiloxanes of the general formula $(CH_3)_3Si—[O—Si(CH_3)_2]_n—[O—Si(Ch_2)\{(CH_2)_3—NH—(CH_2)_2—NH_2\}]_x—OSi(CH_3)_3$, where the sum of n+x is a number between 2 and 10,000.

A suitable textile-softening clay is, for example, a smectite clay. Preferred smectite clays are beidellite clays, hectorite clays, laponite clays, montmorillonite clays, nontronite clays, saponite clays, sauconite clays, and mixtures thereof. Montmorillonite clays are the preferred softening clays. Bentonites contain principally montmorillonites, and can serve as a preferred source of the textile-softening clays.

The textile-softening compound is contained in the fabric softeners according to the present invention in quantities from 1 to 5 wt %, and by preference in quantities from 2.5 to 4 wt %, based in each case on the total fabric softener.

The quantity of $C_{16}$ fatty material that is used as a thickening agent is by preference from 0.01 to 0.5 wt % and by preference from 0.015 to 0.4 wt %, and very particularly preferably between 0.02 and 0.1 wt %, based in each case on the total fabric softener.

It is particularly preferred that the ratio of textile-softening compound to $C_{16}$ fatty material be greater than 10:1 and in particular greater than 25:1. It is very particularly preferred that the ratio of textile-softening compound to $C_{16}$ fatty material be in the range from 150:1 to 50:1.

The viscosity of the fabric softeners is by preference in the range from 100 to 300 mPas, determined using a Brookfield RV DV II+P viscosimeter, spindle 2, at 20 rpm and 20° C.

In addition to the $C_{16}$ fatty material and the textile-softening compound, the fabric softeners can contain further ingredients that further improve the applications-engineering and/or aesthetic properties of the fabric softener. In the context of the present invention, preferred fabric softeners additionally contain one or more substances from the group of the enzymes, electrolytes, nonaqueous solvents, pH adjusting agents, perfumes, perfume carriers, perfume microcapsules, fluorescing agents, dyes, soil release polymers, optical brighteners, anti-gray agents, shrinkage preventers, wrinkle protection agents, color transfer inhibitors, antimicrobial active substances, germicides, fungicides, antioxidants, preservatives, corrosion inhibitors, antistatic agents, bittering agents, ironing adjuvants, proofing and impregnating agents, and UV absorbers. Particularly preferably, the fabric softeners of the present invention contain electrolytes, nonaqueous solvents, pH adjusting agents, perfume, and/or dyes as further ingredients.

The fabric softeners according to the present invention can be used to condition textile fabrics.

The fabric softeners can be manufactured in accordance with techniques familiar to one skilled in the art for manufacturing fabric softeners. This can be done, for example, by mixing the raw materials, optionally with the use of high-shear mixing equipment. It is recommended that the softening component(s) and the $C_{16}$ fatty material be melted together followed by dispersion of the melt in a solvent, by preference water. The further ingredients can be integrated into the fabric softener by simply mixing them in.

Table 1 shows fabric softeners E1 to E3 according to the present invention, as well as comparison fabric softeners V1 to V4 (indications in wt % active substance).

TABLE 1

| | E1 | E2 | E3 | V1 | V2 | V3 | V4 |
|---|---|---|---|---|---|---|---|
| Esterquat* | 4 | 4 | 4 | 4 | 4 | 4 | 4 |
| 2-Propanol | 0.44 | 0.44 | 0.44 | 0.44 | 0.44 | 0.44 | 0.44 |
| Palmitic acid | 0.04 | 0.08 | 0.4 | — | — | — | — |
| Oleic acid | — | — | — | 0.08 | — | — | — |
| Stearic acid | — | — | — | — | — | 0.4 | — |
| Lauric acid | — | — | — | — | — | — | 0.4 |
| pH adjusting agent | 0.05 | 0.05 | 0.05 | 0.05 | 0.05 | 0.05 | 0.05 |
| $MgCl_2$ | 0.1 | 0.1 | 0.1 | 0.1 | 0.1 | 0.1 | 0.1 |
| Dye | + | + | + | + | + | + | + |
| Perfume** | + | + | + | + | + | + | + |
| Water | to 100 | to 100 | to 100 | to 100 | to 100 | to 100 | to 100 |
| Viscosity (mPas)*** | 231 | 164 | 930 | 130 | 136 | 720 | 95 |

*N-methyl-N-(2-hydroxyethyl)-N,N-(ditallowacyloxyethyl)ammonium methosulfate

**Because the perfume also has an influence on viscosity, the identical perfume was used in all the fabric softeners.

***The viscosity of the fabric softeners was determined using a Brookfield RV DV II + P viscosimeter, spindle 2, at 20 rpm and 20° C.

Samples E1 to E3 were shelf-stable over several weeks, and exhibited absolutely no undesired changes. Samples E1 to E3 in particular exhibited only very slight changes and/or fluctuations in viscosity during storage. To determine shelf stability, the compositions were stored in electronically controlled heating chambers. The storage time was 4 weeks at 40° C., and 12 weeks at 23° C. A visual and olfactory assessment of the compositions then occurred.

The results show clearly that palmitic acid exhibits better thickening performance than unsaturated fatty acids (see V2) and than saturated fatty acids having shorter (see V4) and longer (see V3) alkyl chains.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A liquid fabric softener containing 1 to 5 wt % textile-softening compound, based on the total fabric softener, wherein the textile-softening compound has the following formula:

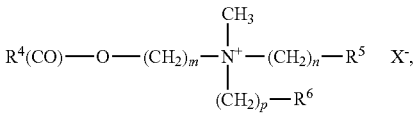

wherein $R^4$ denotes an aliphatic alk(en)yl residue having 11 to 21 carbon atoms, having 0, 1, 2, or 3 double bonds and/or optionally having substituents; $R^5$ denotes H, OH, or $O(CO)R^7$, $R^6$, independently of $R^5$, denotes H, OH, or $O(CO)R^8$, where $R^7$ and $R^8$ each denote, mutually independently, an aliphatic alk(en)yl residue having 11 to 21 carbon atoms having 0, 1, 2, or 3 double bonds, m, n, and p can each, mutually independently, have the value 1, 2, or 3, and $X^-$ denotes either a halide ion, methosulfate ion, methophosphate ion, or phosphate ion, as well as mixtures of said anions, and 0.02 to 0.1 wt % $C_{16}$ fatty material that is free palmitic acid as a thickening agent to impart a viscosity of between 100 and 500 mPas to the liquid fabric softener, wherein a weight ratio of the textile-softening compound to the $C_{16}$ fatty material in the liquid fabric softener ranges between 50:1 and 150:1.

2. A method of softening textiles, comprising:

conditioning the textile fabrics by adding the liquid fabric softener of claim 1 to the textile fabrics while laundering them.

3. A method of increasing the viscosity of a liquid fabric softener, comprising:

combining 0.02 to 0.1 wt % $C_{16}$ fatty material that is free palmitic acid to a liquid fabric softener selected from the group consisting of quaternary ammonium compounds and comprising 1 to 5 wt % textile-softening compound based on the total fabric softener, the fatty material imparting a viscosity of between 100 and 500 mPas to the liquid fabric softener, wherein a weight ratio of the textile-softening compound to the $C_{16}$ fatty material in the liquid fabric softener ranges between 50:1 and 150:1.

4. A method for manufacturing a fabric softener containing 1 to 5 wt % textile-softening quaternary ammonium compound based on the total fabric softener, and 0.02 to 0.1 wt % $C_{16}$ fatty material that is free palmitic acid in which the textile-softening quaternary ammonium compound and the $C_{16}$ fatty material are melted together and the resulting melt is dispersed in a solvent, the fatty material imparting a viscosity of between 100 and 500 mPas to the liquid fabric softener, wherein a weight ratio of the textile-softening compound to the $C_{16}$ fatty material in the fabric softener ranges between 50:1 and 150:1.

* * * * *